United States Patent [19]

Ouderkirk et al.

[11] Patent Number: 5,067,289

[45] Date of Patent: Nov. 26, 1991

[54] FOUNDATION SYSTEM FOR MANUFACTURED HOUSING

[76] Inventors: Dale L. Ouderkirk, R.R. 1, Box 107; Donald R. Ouderkirk, Rte. 47, both of Redfield, N.Y. 13437

[21] Appl. No.: 545,381

[22] Filed: Jun. 28, 1990

[51] Int. Cl.[5] ..... E04B 1/02; E04G 21/00; E02D 27/10

[52] U.S. Cl. ..... 52/169.11; 52/169.8; 52/299; 52/742; 52/292

[58] Field of Search ..... 52/169.6, 169.8, 169.11, 52/169.14, 299, 742, 292, 293

[56] References Cited

U.S. PATENT DOCUMENTS

| | | | |
|---|---|---|---|
| 1,363,273 | 12/1920 | Ruff | 52/299 |
| 2,867,301 | 1/1959 | Benton | 52/299 |
| 3,184,893 | 5/1965 | Booth | 52/742 |
| 3,664,082 | 5/1972 | Zintez | 52/742 |
| 3,845,598 | 11/1974 | Tate | 52/742 X |
| 4,001,990 | 1/1977 | Chase et al. | 52/169.11 X |
| 4,124,963 | 11/1978 | Higuchi | 52/742 |
| 4,457,118 | 2/1984 | Bowen . | |
| 4,512,120 | 3/1985 | Lindal . | |
| 4,563,842 | 1/1986 | Lewis | 52/169.11 X |

FOREIGN PATENT DOCUMENTS

| | | | |
|---|---|---|---|
| 2555626 | 5/1985 | France | 52/293 |
| 119829 | 9/1980 | Japan | 52/292 |
| 58635 | 2/1990 | Japan | 52/292 |

*Primary Examiner*—John E. Murtagh
*Assistant Examiner*—Deborah McGann Ripley
*Attorney, Agent, or Firm*—Wall and Roehrig

[57] ABSTRACT

A prefabricated manufactured housing foundation system is provided for the easy installation of manufactured housing units without the necessity of a crane. The foundation of wooden modules is constructed of treated below-grade lumber that can be quickly and easily installed on special footings having wooden stub wall structures for receiving the wall units around the periphery of the unit. Suitable wooden pier structures are provided to support the manufactured housing units as required. The entire assembly is manufactured in modular form for easy installation after the units have been set on the foundation and for backfilling to normal grade to product an insulated frost-free basement area for manufactured housing without the cost and time involved in a conventional concrete basement foundation.

16 Claims, 3 Drawing Sheets

FOUNDATION SYSTEM FOR MANUFACTURED HOUSING

BACKGROUND OF THE INVENTION

This invention relates to a foundation system for manufactured housing, and more particularly to a modular wooden foundation wall and pier design on which mobile and manufactured housing units can be readily placed, to simply and easily form a below grade foundation creating a frost-free basement area underneath a manufactured housing unit.

Manufactured housing has become very cost effective when compared with conventional homes because it is made in a factory where high-productivity, mass-production techniques can be employed. Foundations, however, still form a major obstacle, both in time and cost, and as a consequence many mobile manufactured homes are set above grade with at best a wind skirt around the periphery to at least partially enclose the space between the unit and the ground. This above grade placement has saved considerable time and cost in the placement of the unit, but the heating problems of such an installation, particularly in the northern climates have become so severe as to require an insulated basement area. To place a manufactured unit on a conventional foundation results in much of the convenience and cost of the modular unit being dissipated in the construction of the foundation. This is particularly so in conventional foundations where the unit has to be placed by use of a crane and applies equally to mobile and modular units.

As used herein, "mobile" applies to units that have built on longitudinal beams or trusses which can have wheels mounted thereon for over-the-road transport. "Modular" is defined to refer to a manufactured unit adapted to be mounted on a foundation in which more conventional floor joists are placed within an outer frame. The road transportation must be accomplished on special trailers that will adequately support the unit especially in the longitudinal direction against the stresses of such movement.

OBJECTS AND SUMMARY OF THE INVENTION

It is therefore an object of the present invention to provide a foundation system for manufactured housing that overcomes the shortcomings of the prior art.

It is another object of the present invention to provide a foundation system for manufactured housing in which a prefabricated, sectional, below grade foundation wall and pier combination is provided for securely receiving a manufactured housing unit.

It is another object of the present invention to provide a sectional foundation system for receiving thereon a manufactured housing unit in which the housing unit can be delivered by conventional wheeled trailer, and set on the foundation without the use of a crane.

It is another object of the present invention to provide a manufactured housing foundation system that provides a belowgrade footing and modular wooden wall sections that permit a full frost-free basement area to be provided underneath the manufactured housing unit.

It is a still further object of the present invention to provide a foundation system for manufactured modular units of housing that can be quickly and easily installed using wooden wall sections, sub wall footings, and modular wooden piers of specially treated wood for below-grade installation.

It is another object of the present invention to provide a modular foundation system including wall sections that can be installed after the manufactured housing unit has been positioned in place by a wheeled vehicle that delivered the unit to the site.

It is another object of the present invention to provide a foundation system for manufactured housing units in which multiple modules can be placed by a wheeled vehicle without the use of a crane by installation of prefabricated wooden wall units and pier units.

It is a still further object of the present invention to provide a foundation system for manufactured housing units in which the unit may be delivered on a wheeled trailer, the unit placed in position over a foundation in which footings have been prepared, the foundation erected using modular wall sections and piers for supporting the housing unit and then after the tractor is withdrawn the end foundation wall section is completed.

In one embodiment, this is accomplished by providing a modular wooden stub wall footing, together with a plurality of pier footings spaced apart a sufficient distance so that the mobile unit can be placed in position over the footings by backing the integral wheeled trailer in from one end, erecting the piers and foundation walls in place to bear the load of the mobile unit on the footings previously installed, and the wheels and trailer tongue removed. Once the vehicle parts are removed, the open side of the foundation is then filled in with the modular foundation wall units and the entire structure back-filled to form a conventional appearing housing unit having a below grade, frost-free basement area.

These and other further objects and advantages will become apparent from the following description and drawings in which:

DETAILED DESCRIPTION OF A PREFERRED EMBODIMENT

Figure 1:
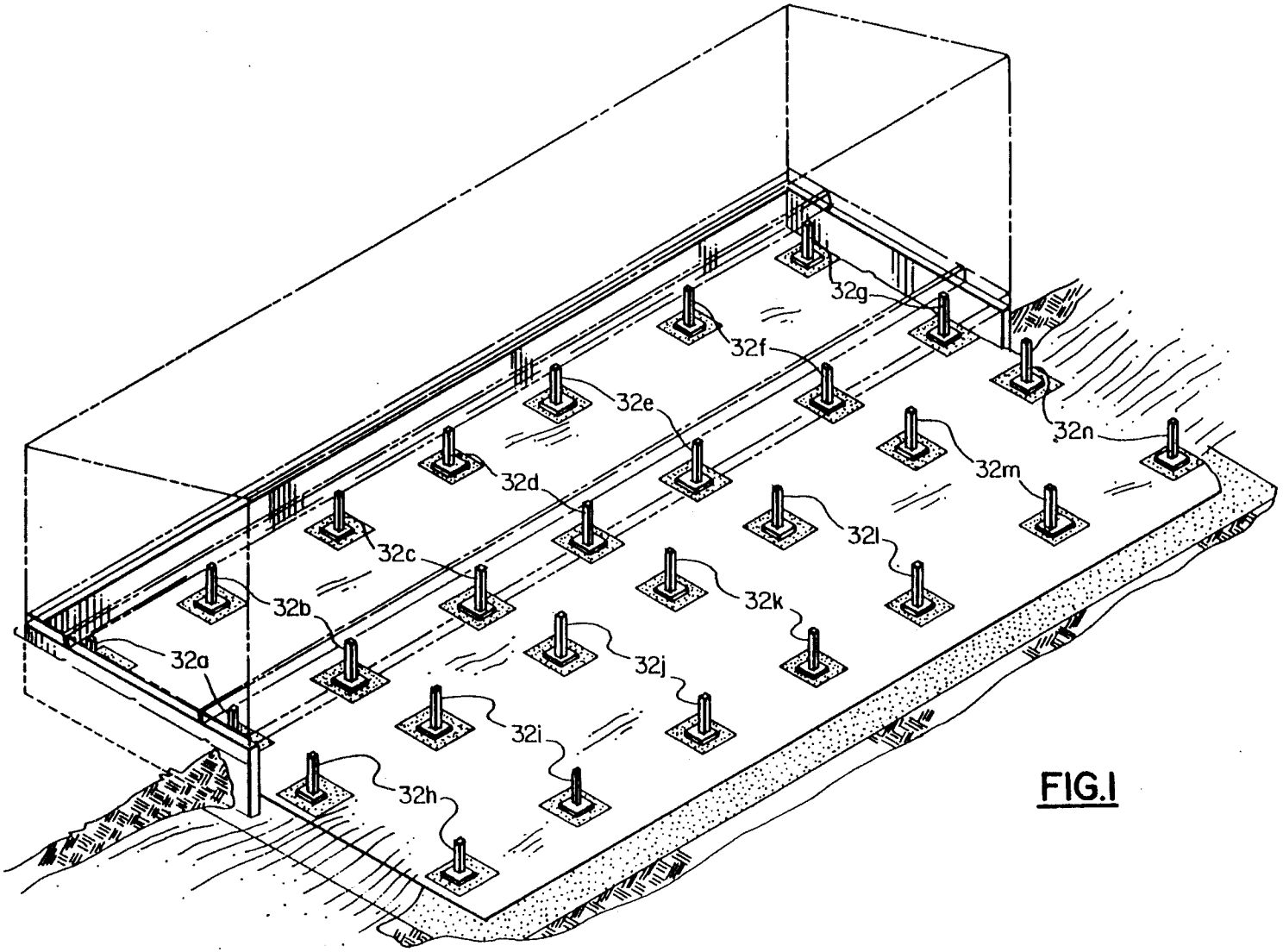
FIG. 1 is a perspective view of a foundation for a mobile manufactured housing unit with a single unit shown in phantom thereon.
Figure 3:
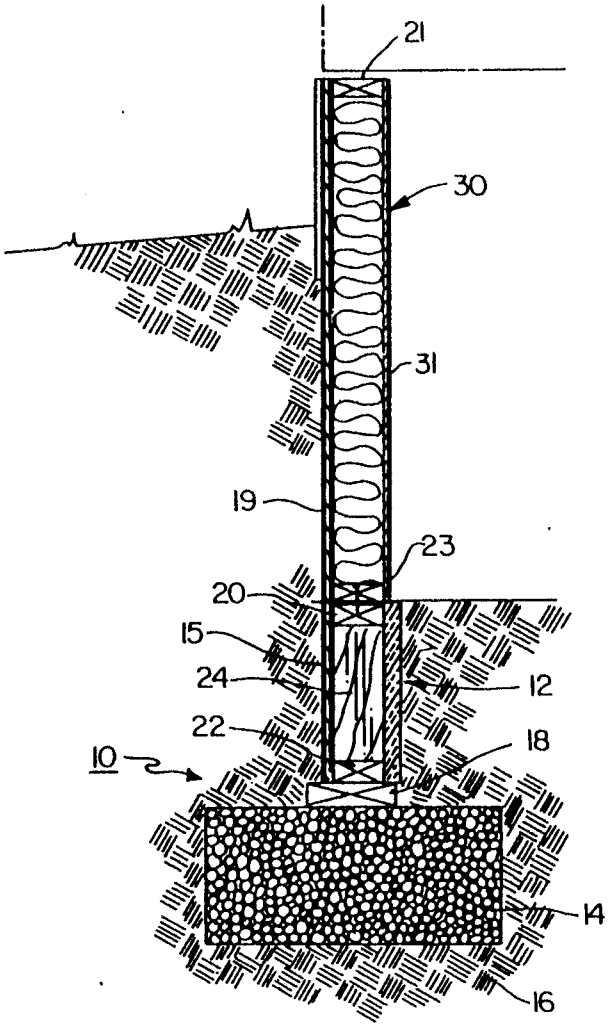
FIG. 3 is a cross-sectional view of a side wall and footing according to the present invention.

Referring now to FIGS. 1 and 3, the foundation system according to the present invention comprises a footing structure 10, including a layer of compacted crushed gravel 14 placed in undisturbed earth 16 around the periphery of the building, a plate 18 positioned on the gravel 14 and a series of stub wall sections 12. Placed on top of the compacted crushed gravel is a 2"×6" perimeter plate 18 of lumber specially treated for placement in contact with grade dirt. Mounted on the plate 18 is a series of stub wall sections 12 formed in modules eight feet long by the desired height to provide the necessary foundation depth for frost-free conditions in the geographic area in which the unit is to be located. The height of the stub wall sections 12 is generally in the 6" to 24" range, but may be varied as will be described herein. The stub wall sections 12 comprise generally 2 ×4 top and bottom plates 20 and 22 with 2" ×4" vertical studs spaced on 24' center all nailed together. An exterior sheet of one-half inch treated plywood 15 is fixed to the exterior of the plates and the studs. The compacted crushed gravel 14 and stub wall sections 12 are located basically completely below grade of the finished basement area, as shown in FIGS. 1 and 3. The combination of the gravel 14 and plate 18 and stub wall section 12 is provided around the entire periphery of the unit to be installed.

Also placed at grade level within the basement area in spaced apart relationship are a plurality of pier footings 10' of compacted gravel 14' in undisturbed dirt 16' with a plate 18' , generally of a size of approximately 2"×12"×12" to provide support for a pier of 6"×6" wood to support the longitudinal beam 25 of the mobile unit to be placed on the foundation. The 6"33 6" column 26 is chosen with the proper length to support the installed housing unit at the desired level, relative to grade, depending again, upon the geographic location of the housing unit, the desired elevation above grade, sub surface rock etc.

Referring now to FIG. 3, the foundation wall of the present foundation system comprises a series of modular wall units 30, each eight feet long and of a height sufficient to provide a minimum of four feet from the finished grade level to the bottom of the footing for northern climate installations. Other depths may be suitable for more temperate climate installations and can be adjusted in accordance with local conditions. With the wall unit 30 fabricated, for instance to fit on top of the stub wall unit 12 and to support the housing I0 unit to be placed on the foundation, a typical construction would include top and bottom plates 21 and 23 of 2"×4" wood treated for below grade installation, an outer panel 79 of half inch treated plywood nailed to the 2"×4" plates and 2"×4" studs (not shown) spaced on twenty-four inch centers along the wall section. The basic wall unit 30, as indicated, is made in modules of eight feet, with partial modules as required to complete the foundation to match the size of the unit to be installed. The interior between the vertical studs is preferably filled with an R13 fiber glass bat insulation material and the interior surface of the wall unit 30 is sealed with a six mil. polyethylene plastic sheet 31.

The stub wall sections 12 and wall units 30 can be prefabricated in a factory using the latest automated processes for later use at the site. They obviously are much cheaper than conventional poured concrete footings and poured concrete walls or block walls and the "installation" labor is greatly reduced. Stud wall sections 12 have a vertical dimension to extend from the footing layer of compacted gravel to the basement grade of the foundation space as shown in FIG. 3. This combined footing structure and the pier footings are placed flush with the basement grade so that a delivery vehicle can be rolled over the footings to position the housing unit in proper position on the foundation. Wall units 30 and pier 26 are installed on the footings to support the housing unit and the vehicle is removed. The wall unit 30, when installed, is fastened to the stub wall in the usual manner with number 16 galvanized nails on six inch centers, and is also suitably fastened to the joist of the building at the top after the building is installed on the foundation wall.

The foundation wall, as shown, may be a bearing wall and take part of the load of the structure, however, due to the general nature of manufactured housing, piers have been found to be desirable and necessary for the proper support of certain manufactured units, particularly mobile units delivered on wheels mounted on the I-beam frame of the unit.

Figure 4:
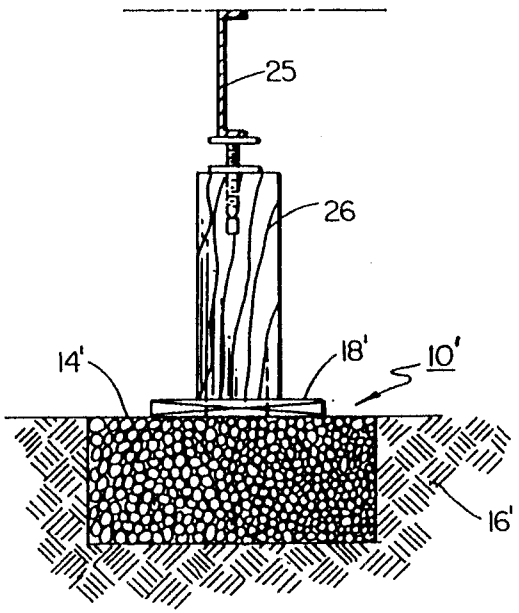
FIG. 4 is a cross-sectional view of a pier in accordance with the present invention.

Referring now to FIG. 4, there is shown a pier design, again with wood treated for below-grade installation, for supporting a unit placed on the foundation system. Piers are spaced at intervals of approximately eight feet, in accordance with the requirements of the manufacturer of the housing units. In mobile units they support the longitudinal beams or trusses 25 of the unit and carry most of the load. In modular units the outer walls bear most of the load and piers will be used for spot support or to support the junction of a double wide. (See FIG. 2) Alternatively in a doublewide modular unit, a shear wall will be constructed on a footing along the center of the joined units to provide structural support for the floor joists of each unit at the center. This is shown diagrammatically in FIG. 2 as 40 which represents either a shear wall or series of piers. The footing would be the same as that shown in FIG. 4.

In the utilization of applicant's novel foundation system, footings will be constructed all around the bottom periphery of the wall and at the appropriate pier locations, as specified by the manufacturer of the manufactured housing unit. One end of the basement area will be sloped to grade to provide access for a wheeled trailer carrying the housing unit. The pier foundation footings and the wall footings are spaced apart a sufficient distance such that the mobile unit or a wheeled trailer vehicle used to transport the modular housing unit over the road can be backed in between them from one end of the foundation without interfering with the pier installation or side wall installation. In practice, the mobile or modular unit is backed into place in the foundation by backing the trailer into the proper location. The unit is then jacked up sufficiently to place the wall units 30 in place around three sides and any piers needed and after they are in place, the unit is lowered onto the foundation and the trailer is removed. After the trailer is removed, additional wall modular units 30 are installed to fill in the open end.

For a double wide mobile unit, the procedure is similar. As shown in FIG. 1, the first mobile unit is placed for instance on the left-hand side and the piers 32 (*a*) (*b*) (*c*) (*d*) (*e*) (*f*) and (*g*) installed to properly support the mobile unit. After the trailer wheels and tongue are removed, as is customary in the industry, the second unit in a double wide can be installed in a similar manner and the piers 32 (*h*)(*i*) (*j*) (*k*) (*l*) (m) and (*n*) installed. The trailer wheels and tongue are then removed in the usual fashion. Next the side wall units 30 are installed to support and steady the structure and to complete the foundation. The unit may then be backfilled in the usual manner.

Figure 2:
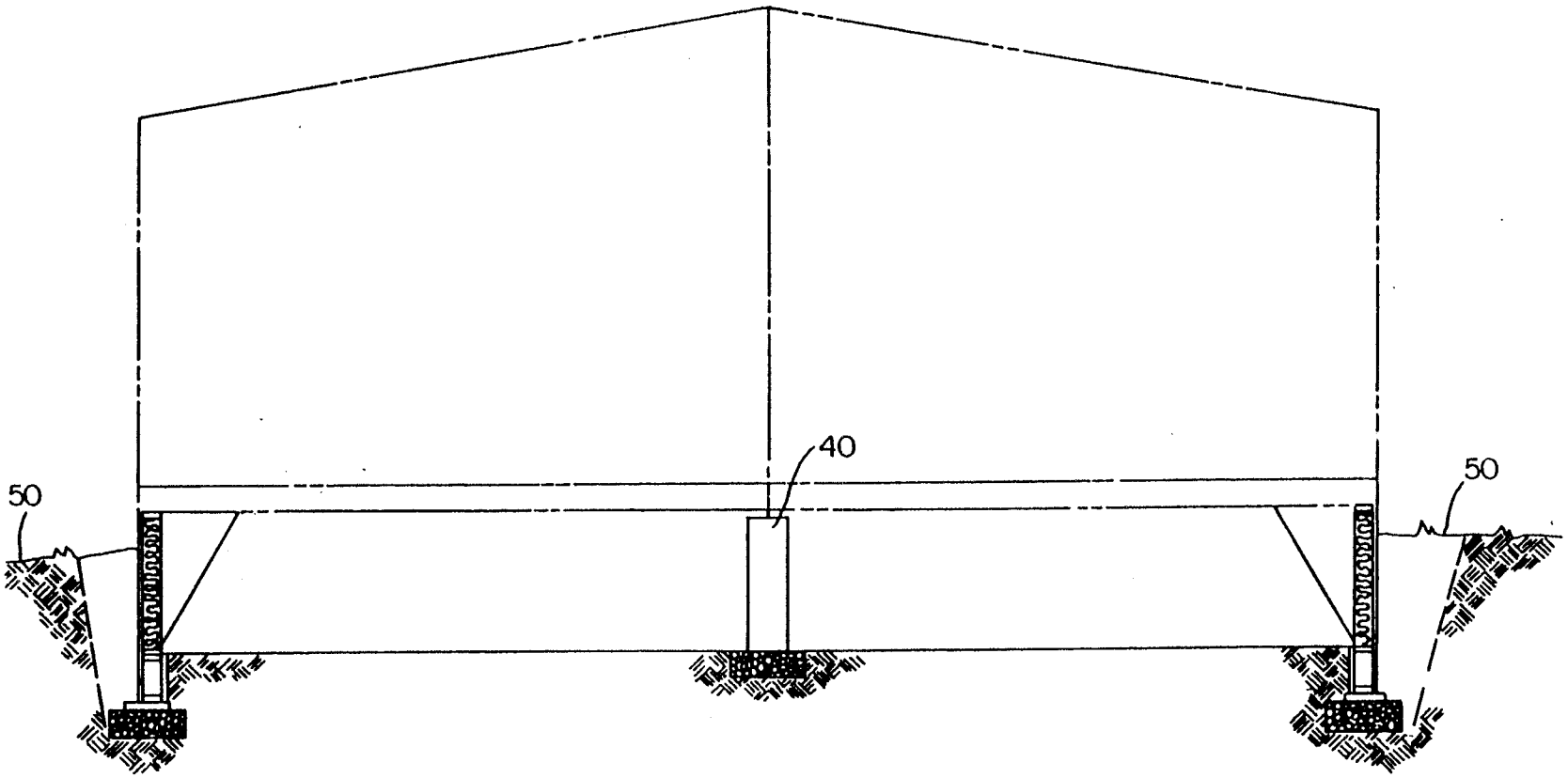
FIG. 2 is a schematic section taken along one end showing a double wide modular housing unit in place on the foundation.

If the double wide is a modular type manufactured unit, the above procedure is followed, except that instead of the piers 32, a shear wall 40 is constructed down the middle of the foundation of FIG. 1. Each modular unit is then supported by the wall units 30 on the exterior walls and the shear wall 40 at the common wall of the double wide units. This is shown in FIG. 2.

Obviously spaced apart piers could be substituted for the shear wall 40, if desired.

After the trailer has been removed and both units have been joined together, the final end wall is installed in modular sections to complete the formation of the load bearing foundation for the modular units. The foundation can then be back-filled in the conventional manner to a grade level as shown at 50, which may come to within ten to twelve inches of the level of the floor of the manufactured unit as shown in FIGS. 2 and 3. With the great flexibility of the "jointed wall construction" of the present invention, applicants are able to install load bearing foundation walls under a wide variety of structures after the unit is wheel transported into place. This not only speeds up installation, but accomplishes it at much lower overall cost since the wooden wall itself is usually cheaper than a masonry wall, no poured concrete is required, and the installation time is greatly reduced.

Also with the "jointed-wall" of the present invention, applicants are able to provide an insulated foundation on sites that normally would require extensive work, such as blasting. By varying the overall height of the footing from some ten inches to twenty or thirty inches, applicants are able to add a shallow wall section of 24" to 32" in height to provide an "on grade" insulated basement installation. In this application little or no excavation is required, and the vehicle carrying the mobile or modular unit can be driven into place essentially on grade. This eliminates the need for a ramped excavation at one end of the foundation to permit the vehicle carrying the housing unit to be backed in and removed. This so called "deep frost footing" with gravel extending several feet down from grade to below the frost line together with the "jointed-wall" concept results in a much more flexible and economic foundation system for mobile and modular manufactured housing. The finished unit forms a complete insulated weather-proof basement for the manufactured housing unit in which the usual plumbing, heating and other utilities can be installed, and which will remain frost-free in most locations and which will provide proper support for the building without the danger of frost, heaves and the like, since the footings are below-grade far enough to be below the frost line and since the interior of the foundation structure will essentially remain frost-free, even in the coldest of winters if the installation instructions have been followed.

Figure 5:
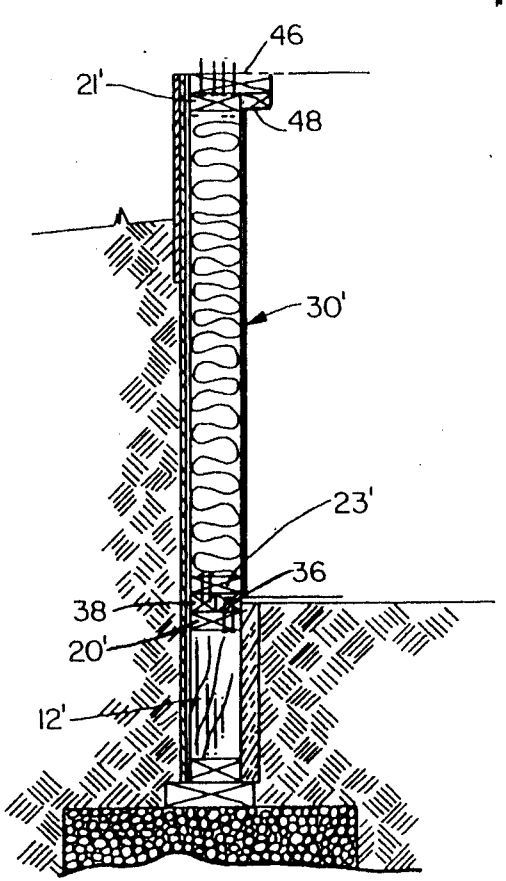
FIG. 5 is a view similar to FIG. 3 of a modified wall according to the present invention.

Referring now to FIG. 5 there is shown a further embodiment in which the interface between the stub wall 12' and the modular wall unit 30' and the housing unit is configured to resist inward displacement of wall modules 30' during backfilling. As may be seen, stud wall 12' has a 2"×2" stringer 36 fastened to plate 20' along the inner edge. Bottom plate 23' of wall module 30' has a 2"×2" stringer 38 fixed along its outer edge. Also at the top of wall unti 30' there is fixed a plate 46 carrying 2"×2" stringer 48 on the inner edge. The plate 46 is secured to the underside of the housing unit and abuts the inner edge of top plate 21' of the wall unit 30'.

The wall section 30' thus has a pair of cleats, top and bottom, that resist inward displacement of wall section 30' along with the usual fastenings to the housing unit and the footing when the basement is being backfilled.

A simple, economical and efficient foundation system for manufactured housing is thus provided which can be easily installed after placing of a housing unit thereon without the use of a crane. Also, the footings can be quickly and easily constructed without the necessity of special forms, or poured concrete, all resulting in more economical housing for the homeowner.

While this invention has been explained with reference to the structure disclosed herein, it is not confined to the details as set forth and this application is intended to cover any modifications and changes as may come within the scope of the following claims.

What is claimed is:

1. A foundation system for manufactured buildings having a below grade basement flor area and foundation walls surrounding said area extending upwardly from said floor area to above grade of a building site comprising, in combination:

a footing structure including a compacted gravel portion, a plate member and a treated wood stub wall portion positioned thereon;

said footing structure being located about the periphery of a basement floor area sized to correspond with a building to be placed thereon;

said footing structure being located below the level of the below grade basement floor area with the top of said stub wall portion being level with the basement floor grade;

a modular stud and plywood perimeter wall unit mounted on said stub wall in multiple units about said footing to form a foundation for receiving and supporting thereon the perimeter of a building to be placed thereon;

a plurality of pier footings located below the level of the basement floor grade within the building foundationa area;

a corresponding plurality of treated wooden piers having a treated wooden plate placed on said pier footings and a wooden column extending upwardly therefrom to support a floor beam of a building to be placed thereon;

said piers being spaced apart a distance greater than the width of a delivery trailer to allow entry into the basement floor area to position a building thereon whereby a manufactured building carried on a delivery trailer may be placed on the foundation system and said piers and modular wall units erected around three sides of said building, to provide foundation support therefore and to permit removal of the trailer from within the basement area; a fourth modular side wall unit positioned to fully enclose said basement area; and a quality of backfill placed around said modular perimeter wall units to complete the formation of a frost free, below-grade foundation for a manufactured building.

2. A foundation system as described in claim 1 wherein said treated wood stub wall portion includes top, bottom and vertical stud members faced with plywood on the surfaces thereof forming modular sections of predetermined height and standard length.

3. A foundation system as described in claim 1 wherein said plurality of wooden piers include a plate approximately 2"× 12"×12" , and a column of 6"×6"×20" of wood treated for contact with the ground; said plate being fastened to said column and said column being fastened to a floor beams of the building placed on the foundation.

4. A foundation system as defined in claim 1 further including a decorative outer facing material fastened on the exterior modular wall surface extending from the top thereof to below finished site grade.

5. A foundation system as described in claim 2 wherein said modular stud and plywood wall comprises a plurality of prefabricated sections of a predetermined height and selected lengths adapted to be fastened together on top of said stub wall to form a perimeter foundation for the building to be mounted thereon.

6. A foundation system as described in claim 5 further including an opening formed adjacent the upper edge of one of said prefabricated sections and ventilation means installed in said opening.

7. A foundation system as described in claim 5 wherein said prefabricated sections comprise top, bottom and vertical wooden stud frame members faced with plywood on the exterior face and a sheet of plastic film on the interior face, said wood being treated for contact with the ground.

8. A foundation system as described in claim 7 further including a layer of insulation fastened within said frame portions whereby the basement area is maintained above freezing in winter.

9. A foundation system as described in claim 7 wherein said plywood is one-half inch thick, said frame portions are 2 ×4's treated for ground contact, said insulation is R-13 fiberglass batts, and said plastic is six mil. polyethylene.

10. A foundation system as described in claim 7 wherein said frame portions have a standard maximum length of eight feet and a height sufficient to allow the footing to be positioned a minimum of four feet below site grade.

11. A foundation system for providing frost-free below-grade basement spaces for modular and mobile manufactured housing units which comprises in combination:

a footing structure formed below basement grade about a space corresponding to the manufactured housing unit to be mounted on the foundation system;

said footing structure including a layer of footing material, a plate member and a plurality of stub wall sections dimensioned so that the top thereof is at basement grade;

a plurality of modular foundation wall units positioned on said stub wall sections sized to extend from basement grade upward above site grade and adapted to receive thereon a housing unit, said stub all sections and modular foundation wall units being fabricated of material suitable for long term contact with the ground, and at least one secondary support member having a height substantially equal to the height of said foundation wall unit, fabricated of material suitable for long term contact with the ground;

so that mobile and modular housing units may be placed on a foundation by a wheeled trailer unit which can be removed therefrom after erection of sufficient wall units and secondary support members.

12. A foundation system as described in claim 11 wherein said footing structure and foundation wall units are disposed about the outer periphery of two housing units placed side by side and a plurality of secondary support members are spaced along the joined sides of said units.

13. A foundation system as described in claim 11 wherein said stub wall sections include top and bottom plate members spaced apart and joined to a plurality of vertical stud members;

said modular wall portion formed of top and bottom plate members spaced apart and joined to a plurality of stud members of a greater length than the footer stud members, and both of said stub wall sections and foundation wall units being sheathed on the exterior with plywood.

14. A foundation system as described in claim 13 wherein said stub wall section and foundation wall units have insulating material therein and said wall units have a vapor barrier on the interior thereof.

15. A foundation system as described in claim 11 wherein said wall units have a vertical dimension great enough to permit the footing structure to be positioned below the frost line.

16. A foundation system as described in claim 15 wherein the combined height of said stub wall sections and foundation wall units equals at least four feet.

* * * * *